US006080460A

United States Patent [19]

Chapman

[11] Patent Number: 6,080,460

[45] Date of Patent: Jun. 27, 2000

[54] HOE-CHUCKING MAT WITH GROUND-SEAL RELEASE MEANS

[75] Inventor: L. Lee Chapman, R.R.-1 Cobble Hill, British Columbia, Canada, V0R 1L0

[73] Assignee: L. Lee Chapman, Cobble Hill, Canada

[21] Appl. No.: 08/888,776

[22] Filed: Jul. 7, 1997

[51] Int. Cl.[7] ..... B32B 3/10

[52] U.S. Cl. ..... 428/54; 428/137; 428/903.3; 52/177; 52/DIG. 9; 404/32

[58] Field of Search ..... 428/54, 137, 903.3; 404/32, 35; 52/177, DIG. 9; 102/303

[56] References Cited

U.S. PATENT DOCUMENTS

| | | | |
|---|---|---|---|
| 2,327,624 | 8/1943 | Denman | 52/177 |
| 3,793,953 | 2/1974 | Lewis | 102/22 |
| 5,131,787 | 7/1992 | Goldberg | 404/32 |
| 5,482,754 | 1/1996 | Crook | 428/54 |

*Primary Examiner*—Alexander Thomas

[57] ABSTRACT

A mat comprising shorter and longer lengths of tread portions cut from recycled tires and strung on cable is specially devised for protecting small-scale ground level ecosystems from destruction by crawler track propelled heavy equipment. To prevent earth and vegetation from being ripped up when the mat is removed after being pressed into the ground by equipment operated atop it, stiffened permanent airways, rectangular in plan view, are systematically distributed throughout the main central portion of the 'hoe-chucking' mat, called such by virtue of boom-mounting excavators called 'hoes', which are forbidden (by regulations) entry to certain environmentally sensitive areas unless accompanied by mats to crawl on. The same mat can be swung through the air to knock branches off trees, but cannot be used as a blasting mat, though the service duty conditions endured in the company of hoes are comparably severe.

1 Claim, 4 Drawing Sheets

HOE-CHUCKING MAT WITH GROUND-SEAL RELEASE MEANS

This invention relates to temporary protective ground-covering means in the form of a mat for frequent successive placement atop selected areas of natural environment characterized by the presence at ground level of small-scale ecosystems requiring protection against the effects of crawler track systems propelling heavy equipment—eg. the boomed excavators commonly used in logging, called 'hoes'—into such an environment.

BACKGROUND OF THE INVENTION

Moving cleated crawler tracks in direct engagement with the ground operate in a well-known distinctive fashion from which small-scale ecosystems at ground level require a much higher degree of protection than from large tired wheels rolling over them. Rotation of the hoe base is accomplished by running the opposed parallel crawler tracks in opposite directions, and this motion always causes an oblique shearing action of cleats against any surface supporting the hoe. Frequent short to-and-fro adjustments of base location are in practice nearly as destructive because of the shearing action produced whenever traction is not perfect, which it seldom is.

The devising of what the Pacific Northwest logging industry now calls 'hoe-chucking mats' raises design issues distinct from simple support issues addressed by devisors of mats for temporary roadways for wheeled traffic. The support capability of any matlike structure atop which equipment is operated is not a reliable indicator of the protection afforded to smallscale ecosystems under a hoe-chucking mat. From the industry perspective, hoe-chucking mats are increasingly important because heavy equipment accompanied by hoe-chucking mats is allowed to range more freely into natural areas where government regulations prohibit direct engagement of the ground by crawler track propulsion systems. If it 'gets out' that mats are employed which do not effect the intended purpose of ecosystem protection, the next thing industry can expect is government imposed standardization of hoe-chucking mats. At present however, there are too few experts and too little research in this field, so I hope in my own way to advance the art by what I have devised with narrow focus on the special needs in hoe-chucking.

In hoe-chucking, the same crawler tracked equipment (hoe) from which the ground is to be protected is typically employed to pick up and shift a mat from location to location, in a leap-frogging manner. The hoe crawls onto its mat to take a new position from which the operator directs all the necessary work within reach of the boom.

Two 'no-no' principles of hoe-chucking mat design I conceived after watching actual field operations are: (1) the topside of the mat should not have features which engage with the crawler track cleats in a manner transmitting forces tending to either destroy the mat or disturb the mat's placement; and (2) the underside of a hoe-chucking mat should not form a substantially airtight seal with the ground. The possibility of counter-rotation of a mat on wet ground, when the equipment base is rotated, is somewhat more readily grasped, perhaps, than the possibility that earth adhering to the underside of a mat will be pulled up with mat removal, but I saw both happen.

When the blanket-like strip of ground was pulled up with a mat, the base of the hoe working atop the mat for about twenty minutes had been repositioned frequently both by rotational and to-and-fro motions. In this case the mat position was not disturbed and the hoe pressed the mat into the underlying earth apparently quite evenly. Lacking a better term—what I call a 'ground-seal' of the mat to the ground was formed. The removal of the mat was of course 'no problem' to the operator of the powerful hoe, but the mat's removal caused extensive uprooting of the many small plants living at the location that had been 'protected'. I do not believe anyone has addressed this problem before me.

In looking at mat design for hoe-chucking, I always consider whether or not the features of structure and arrangement in a mat really suit it to protecting ground level ecosystems in conditions of use—including the mat's removal. I refer to interaction of a mat with the ground below as 'underside matters', and with equipment above as 'topside matters'. Mat design which does not address both underside and topside matters is not hoe-chucking mat design, in my opinion. Only because literature on the design issues of concern herein is apparently non-existent, I have turned to patents of certain mats which were devised specifically for one or the other of two applications: 1. temporary roadway mats; and 2. blasting mats. Mats of both categories are available in sizes making it tempting to adopt them as hoe-chucking mats.

Jerry Goldberg invented "a mat system for creating a temporary instant roadway surface over unstable ground" (claim phrasing), and was on Jul. 21, 1992 granted U.S. Pat. No. 5,131,787 for a TIRE MAT AND METHOD OF CONSTRUCTION. According to one version of his conception of using old tires in mats, he employs both a tire's (a.) sidewall portions, and (b.) tread portion, in the same product—a product which in my opinion deserves to be field-tested for possible application to hoe-chucking.

Assuming the orientation illustrated in FIG. 3, and addressing topside matters, I note that the wheel tires 27 of a vehicle traveling across the layer of overlapped sidewall portions 10, wired to one another by means W2, would not (because of the nature of the wheel tires) engage the means W2 in any severely detrimental way, even if the wheeled vehicle were moved in short to-and-fro motions on the mat. FIG. 2 depicts each pair of dual wheels 27 as straddling wiring means W2, but I hardly think such precision of driving is necessary; the mat could be run over from any direction by a wheeled vehicle without problems arising. However, the cleats of crawler tracks would in my opinion interact in a less harmless manner with overlapped tire sidewalls 10 interconnected by exposed W2s—keepinq in mind the rotational and to-and-fro motions of tracks in adjusting the base of a hoe working atop the same mat all day, often with rain supplying lubricant between the crawler track cleats and mat surface. Shearing action in this case is potentially damaging to things like twists of wire sticking up from a mat, no less than to plants sticking up from unprotected ground. The difference in toughness between a plant and a twist of wire is nothing to a powerful crawler track propulsion system—either can be sheared off.

The frequent handling of a hoe-chucking mat by means of powerful claws or clamshells on hoes is another point with regard to which the topside of Mr. Goldberg's mat leaves something to be desired.

Next, addressing underside matters, I note that Mr. Goldberg's tread portions 15 lie basically flat against the ground in FIG. 3. Referring to the end view presented by FIG. 2, rows of tread portions 15 lie in slightly deformed conforming contact with the ground. The illustrator commendably incorporated in FIG. 3 a realistic conformation of flexible structure with contours of the ground. Unfortunately neither Mr. Goldberg nor anyone else to my knowledge has said anything about what happens at the ground level when removing temporary road mats. Before anyone thinks a temporary road mat can be substituted for a hoe-chucking mat, because 'a mat is a mat', thought should first be given to what the road mat does to the ground when it fulfills the temporary function attributed to it, by being removed.

The proportionately quite narrow spaces shown in Mr. Goldberg's FIG. 2 between treads 15 would in hoe-chucking practice tend to become plugged with small plants and moist earth, causing there to be insufficient airway volume through his mat to ensure easy separation of mat and ground.

A tire mat according to the above-considered art possesses potential for hoe-chucking if overturned, and I believe that field tests both ways over would confirm this and all my foregoing analyses.

What happens to the ground in the case of blasting mats used for their intended purpose has often been closely studied by explosives engineers, but nothing to my knowledge has been published concerning their potential for hoe-chucking, though I know that some are being used. They are often conveniently ready-to-hand near hoe-chucking sites, since road building into the areas where small ecosystems require protection often involves extensive blasting.

Because blasting mats must be built to prevent upward passage through them of flyrock, most are designed without openings of a size larger than rock fragments thrown upwardly by a blast. To my way of thinking, and from what I have seen, the same absence of openings is to blame for their tendency to form an undesirable ground-seal when heavy equipment is operated atop them. There is, however, one particularly ingenius blasting mat known to me only from a perusal of patent literature which seems to diverge from our local practice in blasting mats, and which seems at first glance to solve the ground-seal problem—maybe, if so, affording a mat inherently of utility both for blasting and as a ground-protective hoe-chucking mat.

I refer to U.S. Pat. No. 3,793,953, BLASTING MAT, by Douglas L. Lewis., issued Feb. 26, 1974.

This clever Canadian invention is especially relevant to cite because of a superficial resemblance to my invention. The general similarity of appearance is encountered in the plan views (FIG. 1, Lewis, and FIG. 1, mine). But what Lewis really provides is "a mat constructed of a plurality of interleaved rectangular plates of resilient material arranged on edge in side-by-side spaced relationship in contiguous rows and strung together to secure the spaced plates in position in the mat while at the same time allowing movement of the edges of the plates when the mat is flexed to reduce the spacing between the plates." (Col. 1, lines 61–68, my underline) At Col. 3, lines 26–28, Lewis says, "It should also be noted the plates and spacers are sufficiently loose to permit the edges of plates 1 to move together . . . " (my underline)

Referring to FIGS. 5 and 6 illustrating the manner according to which Lewis's openings are closed in use, the edge movement of plates, mentioned above, is associated with a blast directed upwardly from beneath the mat. Because Lewis's "sufficiently loose" plates flex to close the openings, in the blasting application, I am of the opinion that when the force against them is the weight of overlying heavy equipment they will tend to close, still producing 'V'-shaped recesses, but in this case inverted. Earth and small plants wedged into inverted 'V'-shaped recesses would tend to be dug out and pulled from the ground, with removal of a Lewis mat used for hoe-chucking. In other words, the openings in mat structure provided by Lewis are not designed to be maintained open in the mat's intended use, and, because of the specified flexure and loose joining of elements also would not reliably be maintained open in hoe-chucking. The similar plan views are misleading if statically regarded, and in my opinion, this clever blasting mat by Lewis does not possess nearly the degree of potential an overturned Goldberg mat might have as a protective cover for ground level ecosystems, when crawler tracked heavy equipment is shifted about atop it.

A mat devised with utility both for hoe-chucking and blasting is an item I do not care to attempt in the present invention.

SUMMARY OF THE INVENTION

My chief objective of solving the problem of ground-seal—that is, of the phenomenon of a blanket-like large strip of vegetation and moist earth being sometimes pulled up when a mat used for hoe-chucking is lifted—is achieved, I have found, by including in a hoe-chucking mat, between the planes respectively of an upper mat surface and of a lower mat surface, ground-seal release means comprising systematically distributed permanent airways bounded by stiffened, internested laminar elements exhibiting curvature (in cross-section) at nominal upper and lower edges.

According to the preferred method of constructing a hoe-chucking mat embodying the invention, quantities of laminar elements, all similar in thickness, width, and cross-sectional shape, are obtained by chopping tire-tread portions of tires, from similar tires, to two different lengths such that shorter length laminar elements are preferably approximately one/twelfth the length of longer laminar elements.

Preferably five one-inch diameter steel cables are employed in stringing the mat, and all laminar elements are punched to provide the necessary apertures through which cable is threaded.

Location of the punching sites is dictated by both the desired spatial distribution of airways in the mat and the desired separation of the five cables which are arranged parallel with one another. A single aperture is punched at the centroid of each shorter length laminar element. In each longer length laminar element, five apertures are punched at intervals from one another equal to one/fifth the longer laminar element length, there being four such intervals because there are two apertures on either side of a middle aperture punched at the centroid of each longer length laminar element. It will be observed that the half-size intervals on either side make a substantial contribution to ensuring ground-seal release.

In the major central portion of the mat, no two shorter length elements are immediately adjacent one another, hence there is but one way to string the specified parallel cables through the punching sites; and, at the two opposite ends bracketing the central portion, at each end, several rows of longer length elements are arranged immediately adjacent one another without interspersed shorter elements. This is a design feature specifically incorporated to facilitate removal and repositioning the mat by means of hoe clamshell or claws which conceivably could penetrate and become wedged into openings if there were any at these end locations.

All the slightly 'C' shaped in cross-section laminar elements are highly compressed together in internesting fashion with one another, edge portions of one laminar element overlapping and cupping against the immediately adjacent laminar element, long or short alike, storing to a considerable extent, in a spring-like manner, the energy required during mat assembly to compress the laminae together. Since the openings provided are stiffened to remain open, my manner of construction precludes using my mat as a blasting mat, but provides a superior hoe-chucking mat that does not pull up with it any significant amount of earth when lifted for repositioning over the next spot to be protected from effects of crawler track motions. When applied to roadway mat duty for only a brief duration of time, as is certainly feasible, the 'open-work' structure of my mat ensures that roadway removal will minimize disturbance of the vegetation temporarily covered.

DETAILED DESCRIPTION OF THE INVENTION AS ILLUSTRATED

Figure 4:
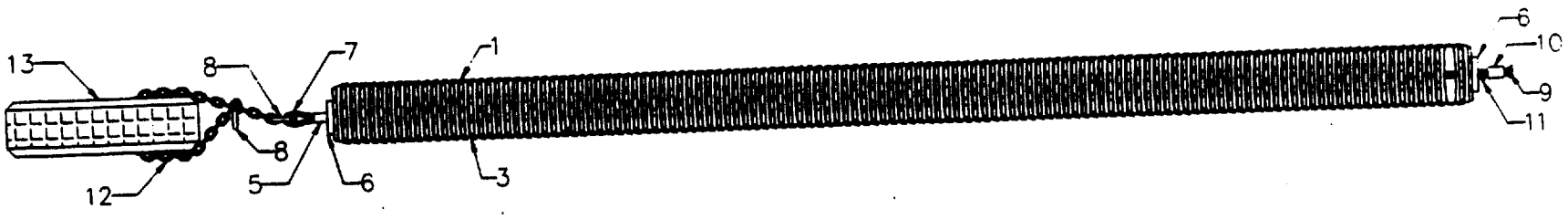
FIG. 4 is a side view illustrating the same mat.

With reference to the side view presented by FIG. 4, the curvature of edge portions 3 of all elements 1 and 2 is deliberately shown very slight, because the whole assemblage is highly compressed between plates 6 at left and right ends. Pressed sleeves 5 at the left end, and cable clamps 9 plus quick-fix knobs 10 at the right end, are the means attached to cables 11. seen in this view only at the extreme right end, whereby the whole assembly is prevented from expanding instantly in the longitudinal direction of the mat, were the built-in spring-like force deforming portions 3 of all tread elements 1 and 2 suddenly released.

Not shown are powerful winches which in cooperation with a large jigging frame are employed to compress the assembly after it is first strung on lengths of cable longer than cables 11 in the finished product. Clamps 9 and knobs 10 are attached while jigging frame stakes block outward movement apart from one another of plates 6 which have been forced toward each other using the winches, the cables being pulled taut at the same time. The plate-blocking stakes are left in place until all cables have been cut just outwardly of knobs 10. Removal of the stakes is the 'moment of truth' regarding whether or not clamps 9 and knobs 10 have been properly secured using hand tools. Pressed sleeves 5 at the other end are not similarly a source of concern, as they not only frictionally engage a doubled-over length of cable forming eyes 7, but are put on by a special high-pressure machine, in view of intending them to be left permanently in place.

Figure 3:
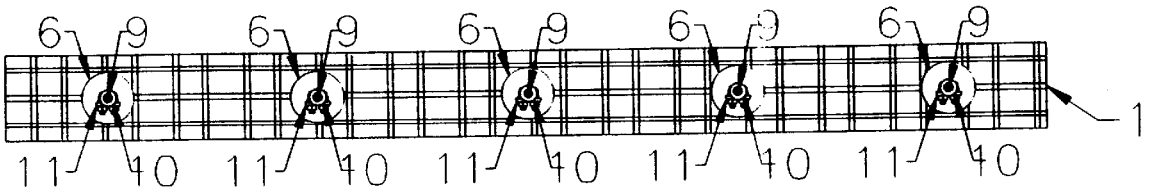
FIG. 3 illustrates the same mat viewed from the opposite end.

Whenever a mat is re-jigged for repair for any reason, it is the 'quick-fix' knobs 10 and clamps 9 which are attended to, in order (with due care because of the compression) to disassemble a mat. FIG. 3 shows the end then worked on.

Figure 1:
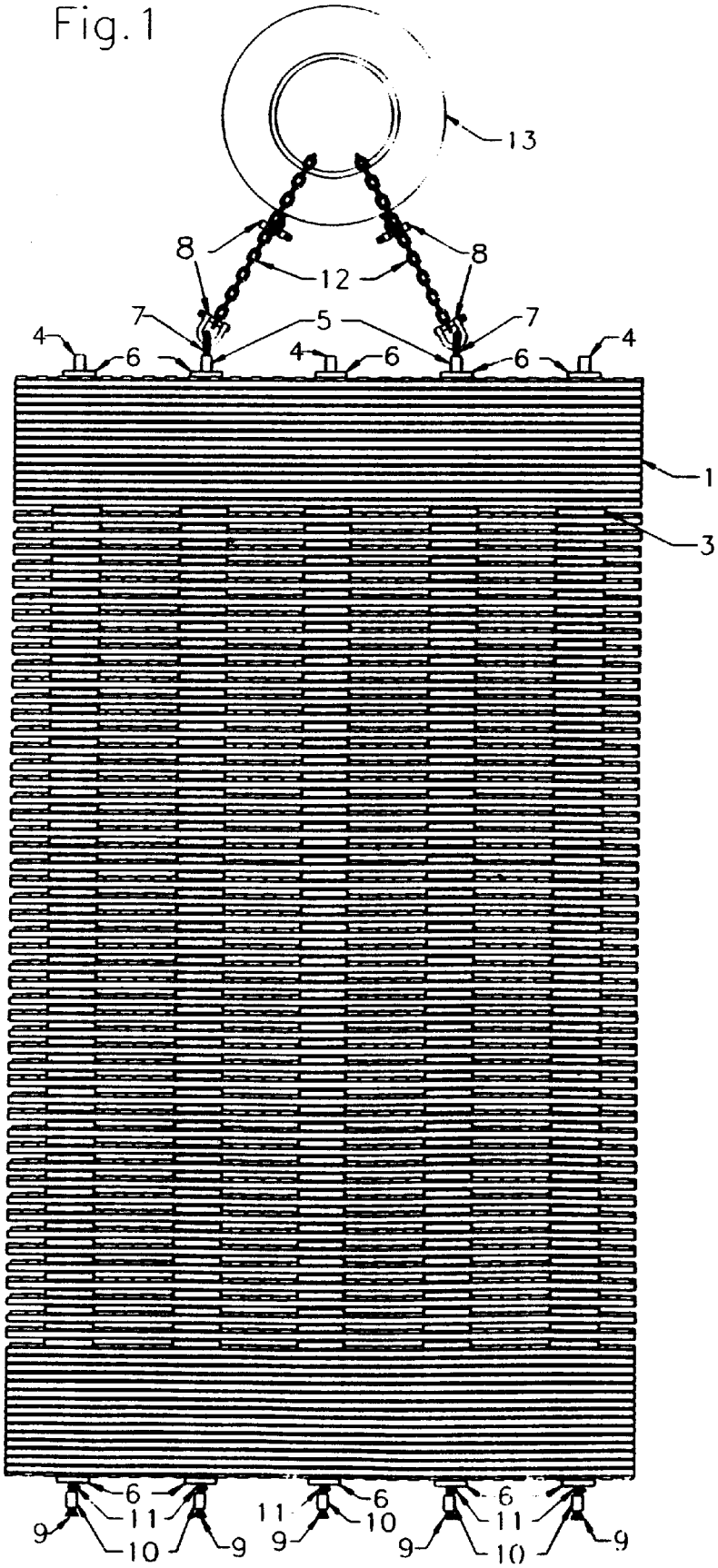
FIG. 1 is a plan view illustrating a hoe-chucking mat according to the invention.
Figure 2:
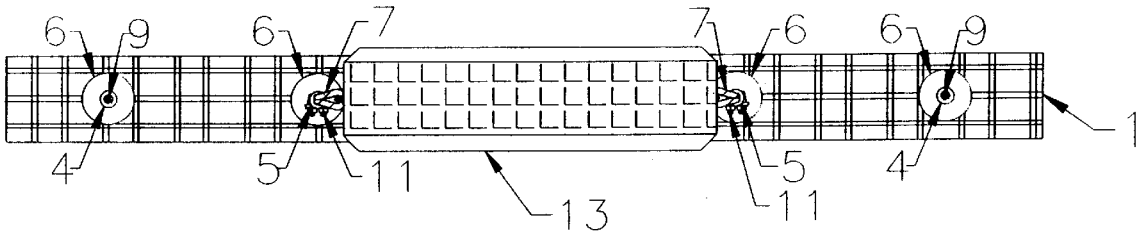
FIG. 2 illustrates the same mat viewed from one end.

With reference to any of FIGS. 1, 2, or 4, shackles 8, chain 12, and tire 13 comprise but highly useful handling means specially contrived to accomodate equipment and/or equipment operators not capable of slipping one jaw along under the 'solid' rowed end of a mat to break the ground-seal and then to lift the mat directly—and always useful to provide better 'swing' of a mat when raised high into the air and swung against branches of a tree before felling it, in order to delimb it. De-limbing using a mat, of course, means that unless another hoe-chucking mat is available and in its proper use, the hoe has commenced working with crawler tracks in direct engagement with the ground. Two mats unattached to one another are the best plan, for then the hoe can 'leap frog' them, crawling onto one after the other in alternation, and never crossing unprotected ground because they are set down immediately adjacent one another when leapfrogging.

On a busy day, a hoe-chucking mat will be repositioned dozens of times, used for de-limbing when 'idle' (not under the hoe), and whenever under a hoe will be subjected to frequent adjustments of the hoe base by means of potentially destructive crawler track cleat shearing motions.

Having described my hoe-chucking mat in greater detail, with explanation of the essential points in its fabrication, and describing its use, the relevance of extensive background remarks above is hopefully now well appreciated. A mat used for hoe-chucking is put to far severer duty than roadway mats devised in contemplation of occassional passage over a single mat of a wheeled vehicle. In truth, a hoe-chucking mat demands durability comparable to blasting mats, but inasmuch as I have specified stiffened open-work in my hoe-chucking mat, so as to save as many small plants' lives as possible by preventing ground-seal—and indeed so as to crush fewer plants and ground-dwelling insects—it is left for another time to devise a hoe-chucking mat better suited for blasting the ground under it.

Finally, applying retrospective analysis with regard to both topside and underside matters to my own mat, it will have been observed that both surfaces are the same: substantially devoid of protrusions or significant unevenness which might on the nominal topside be destructively engaged by crawler cleats or on the nominal underside tend to dig the ground. Rain will lubricate anything undesirably, but at least the stiffened airways through my mat assist prompt drainage through it and fast drying out when rain ceases. Puddles do not form on my mat, as they would if 'C'-shaped treads pointed open sides of 'C's upward. Ground-seal release by means of the same airways is the vital point with respect to preventing a strip of earth and small vegetation from being pulled up with mat removal. The spring-like character of deformed slightly curved edge portions of tread elements is provided at manufacture to preserve mat geometry in use.

It will be evident that many minor variations pertaining to such as the number of rows of longer elements 1 immediately adjacent one another at the mat's ends, number of shorter elements 2, number of cables 11 etc. can be incorporated without departing from the substance of my invention, for which a temporary monopoly sought shall be limited as next delineated.

I claim:

1. In hoe-chucking mats for temporary protection of ground level ecosystems when crawler track propelled heavy equipment operates upon said mats, a mat structure utilizing portions of recycled tires in cable-strung assembly with one another, wherein said mat structure is characterized by provision of:

a mat body section comprising: a set of shorter length units consisting of tread portions of said recycled tires, a set of longer length units also consisting of tread portions of recycled tires, every unit of said tread portions irrespective of length being perforated to receive cable strung therethrough; multiple similar lengths of said cable; an arrangement leaving no two of said shorter length units of said tread portions adjacent one another, thereby systematically distributing permanent airways through said mat body section, said airways being rectangular in plan view and bounded by stiffening means comprising internested deformed edges of said tread portions of recycled tires; said arrangement including at opposite ends of said mat body section successive multiple rows of said longer length units of said tread portions; opposed pairs of perforated cable-receiving rigid plates near opposite ends of each length of said cable strung through rows of said shorter and longer length units of tread portions of recycled tires, said plates during mat assembly being compressed against said rows; clamping means to secure said plates in position on said lengths of cable at mat body ends; and two looped-back and secured cable ends respectively forming a cable eye at each of two of said plates at one mat body end; said mat body section so comprised being united in combination with a mat-handling fixture for ground level mat emplacement and removal, and for hoisted swinging of a mat to de-limb a tree, comprising an intact whole recycled tire looped through by two chains the ends of which are secured by means of shackles to said two cable eyes at one end of said mat body section.

* * * * *